US007483657B2

(12) United States Patent
Ishida

(10) Patent No.: US 7,483,657 B2
(45) Date of Patent: Jan. 27, 2009

(54) IMAGE FORMING APPARATUS FEATURING A CONTROLLER FOR CONTROLLING ROTATION OF A DEVELOPER FEEDING SCREW IN RESPONSE TO AN ANGLE OF INCLINATION OF THE APPARATUS

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 11/670,056

(22) Filed: Feb. 1, 2007

(65) Prior Publication Data

US 2007/0177888 A1 Aug. 2, 2007

(30) Foreign Application Priority Data

Feb. 2, 2006 (JP) ..... 2006-026338

(51) Int. Cl.
*G03G 15/08* (2006.01)
*G03G 15/00* (2006.01)

(52) U.S. Cl. ..... 399/258; 399/260; 399/263; 399/44; 399/49; 399/27

(58) Field of Classification Search ..... 399/27, 399/30, 58, 44, 49, 60, 258
See application file for complete search history.

(56) References Cited

U.S. PATENT DOCUMENTS 5,414,539 A * 5/1995 Kadowaki ..... 358/529
5,652,947 A * 7/1997 Izumizaki ..... 399/58

FOREIGN PATENT DOCUMENTS

JP 7-175304 7/1995
JP 10268592 A * 10/1998

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image forming apparatus includes an image bearing member on which an electrostatic image is formed; a developing device for developing the electrostatic image formed on the image bearing member with a developer including toner and a carrier; a supplying apparatus for supplying into the developing device a supply developer including toner by rotating a feeding screw; inclination detecting means for detecting an inclination of the feeding screw; and control means for controlling rotation of the feeding screw on the basis of a result of detection of the inclination detecting means.

6 Claims, 10 Drawing Sheets

IMAGE FORMING APPARATUS FEATURING A CONTROLLER FOR CONTROLLING ROTATION OF A DEVELOPER FEEDING SCREW IN RESPONSE TO AN ANGLE OF INCLINATION OF THE APPARATUS

FIELD OF THE INVENTION AND RELATED ART

The present invention relates to an image forming apparatus, such as a copying machine, a laser beam printer, etc., which uses an electrostatic recording method or an electrophotographic method, and which develops an electrostatic image formed on an image bearing member with the use of developer made up of toner and carrier.

Generally, an electrophotographic image forming apparatus forms an image using an image forming process which includes charging, exposing, developing, transferring, fixing, and cleaning steps. That is, the peripheral surface of an electrophotographic photosensitive member (which hereafter will be referred to as "photosensitive member"), as an image bearing member, is uniformly charged, and then, the charged peripheral surface of the photosensitive member is exposed according to picture information, effecting thereby an electrostatic image (latent image) on the peripheral surface of the photosensitive member. This electrostatic latent image is developed into a toner image (image formed of toner) with the toner in developer. The toner image is transferred onto a recording medium, such as a sheet of paper, from the photosensitive member. After the transfer of the toner image from the photosensitive member, the transfer residual toner, that is, the toner remaining on the peripheral surface of the photosensitive member, is removed from the peripheral surface of the photosensitive member and recovered; the peripheral surface of the photosensitive member is cleaned. Normally, the recording medium onto which the toner image has been transferred is subjected to heat and pressure to fix the toner image to the surface of the recording medium.

In recent years, demand has been increasing for higher image quality and higher image formation speed in the field of a full-color image forming apparatus. As a result, a two-component developer, which essentially is a mixture of non-magnetic toner particles (toner) and magnetic carrier particles (carrier), has come to be widely used.

In a developer container which stores a two-component developer, the ratio of the toner (toner concentration) relative to the carrier is changed by toner consumption. Therefore, it is desired to keep the toner ratio of the developer in a developer container constant at an optimal level. If the toner concentration in a developer container is improper, it is possible that defective images, such as an image which is wrong in density, an image which appears grainy, an image which suffers from fog, an image which suffers from carrier adhesion, will be formed, and also, that toner will scatter. Thus, from the standpoint of continuously forming high quality images, it is very important to properly control the amount by which toner is supplied to a developer container.

As the toner in a developer container is consumed by image formation, the developer container is replenished, as necessary, with a fresh supply of toner by a toner supplying mechanism as a toner supplying means, by the amount equal to the amount by which the toner has been consumed by the image formation. More specifically, referring to FIG. 13, the fresh supply of toner (which hereafter may be referred to as replenishment toner) is conveyed from a toner container 51 into a toner supplying mechanism 52. Then, the toner is conveyed through the toner conveyance passage 53 of the toner supplying mechanism 52, by the rotation of a toner supplying screw 54, as a toner supplying member, of the toner supplying mechanism 52, into the developer container, through the toner outlet of the toner supplying mechanism 52.

As one of the methods for controlling the amount by which toner is supplied to a developer container, there is a toner concentration controlling method which employs a toner concentration detecting means, such as an optical toner concentration detection system and an inductance detection system. An optical toner concentration detection system detects the changes in the reflectance of developer, with the use of an optical sensor, whereas an inductance detection system detects the changes in the magnetic permeability of developer with the use of a permeability sensor. In other words, the two systems directly detect the changes in the physical property of two-component developer itself, and then, the amount by which toner is supplied to a developer container from a toner supplying means is controlled based on the results of the detection.

There is a toner supply controlling method which employs the so-called patch detection system (image density detection system), which is another system for detecting the changes in the toner concentration in a developer container in order to control the amount by which toner is supplied to the developer container. In this system, a referential latent image (latent image of patch), which is in accordance with a preset picture information, is formed on a photosensitive member, and this referential latent image is developed to form the toner image of the referential patch (which hereafter may be referred to simply as referential toner image or patch image), which is in accordance with the preset picture information. Then, the reflectance of this referential toner image is detected by an image density detecting means, while the image is on the photosensitive member, a recording medium bearing member, or an intermediary transferring member. Then, based on the result of the detection, the amount by which toner is supplied from the toner supplying means to the developer container is controlled.

The toner supplying screw 54 of the toner supplying mechanism 52 is driven so that toner is supplied, as necessary, to a developer container by the computed amount based on the results of the detection by the toner concentration detecting means or image density detecting means, such as the above-mentioned ones.

Further, in recent years, an image forming apparatus has come to be used under diverse conditions. Thus, the number of people which use an image forming apparatus not only in an ordinary place, in which the main assembly of an image forming apparatus is set at an ordinary angle, but also, in unconventional places, such as in an airplane, a ship, a tram, train, etc., in which the angle at which the main assembly of an image apparatus is set is substantially different from the normal angle at which it is set, has been increasing.

For example, if an image forming apparatus becomes tilted as shown in FIG. 14(*a*) while it is used, the amount by which toner is conveyed by the toner supplying screw 54 of the toner supplying mechanism 52 sometimes decreases, reducing thereby the amount by which toner is supplied to the developer container of the image forming apparatus, and therefore, reducing the toner concentration of the developer in the toner container. On the other hand, if an image forming apparatus becomes tilted as shown in FIG. 14(*b*) while it is used, the amount by which toner is conveyed by the toner supplying screw 54 of the toner supplying mechanism 52 sometimes increases, increasing thereby the amount by which toner is supplied to the developer container of the image forming apparatus, and increasing thereby the toner concentration of the developer in the toner container.

That is, if the angle at which an image forming apparatus is set is changed while it is being used, the speed at which toner is conveyed by the toner supplying screw 54 changes in response to the amount of change in the angle of the image forming apparatus, more specifically, the angle between the horizontal plane B and the axial line of the toner supplying screw 54. This in turn changes the amount by which toner is supplied to a developer container. In other words, the amount by which toner is supplied to the developer container does not remain stable, which is problematic.

Japanese Laid-open Patent Application 7-175304 discloses an image forming apparatus which is provided with an inclination angle detection sensor for detecting the angle of the top surface of the body of developer in a developer container, and in which the rotational speed of the supply roller, or the roller for supplying the development roller with developer, is controlled in response to the angle of the top surface of the body of developer in the developer container (amount of deviation in developer distribution in developer container). However, the image forming apparatus stated in Japanese Laid-open Patent Application 7-175304 is not capable of stabilizing the toner concentration in the developer container, even though it is capable of stabilizing the amount by which the development roller is supplied with the developer.

SUMMARY OF THE INVENTION

Thus, the primary object of the present invention is to provide an image forming apparatus which keeps constant the toner concentration of the developer in the developer container, by preventing from changing the amount by which toner is supplied to the developer container, even if the screw for supplying the developer becomes deviated in angle.

According to an aspect of the present invention, there is provided an image forming apparatus comprising an image bearing member on which an electrostatic image is formed; a developing device for developing the electrostatic image formed on said image bearing member with a developer including toner and a carrier; a supplying apparatus for supplying into said developing device a supply developer including toner by rotating a feeding screw; inclination detecting means for detecting an inclination of said feeding screw; and control means for controlling rotation of said feeding screw on the basis of a result of detection of said inclination detecting means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereafter, the image forming apparatus in accordance with the present invention will be described in detail with reference to the appended drawings.

Embodiment 1

[General Structure and Operation of Image Forming Apparatus]

Figure 1:
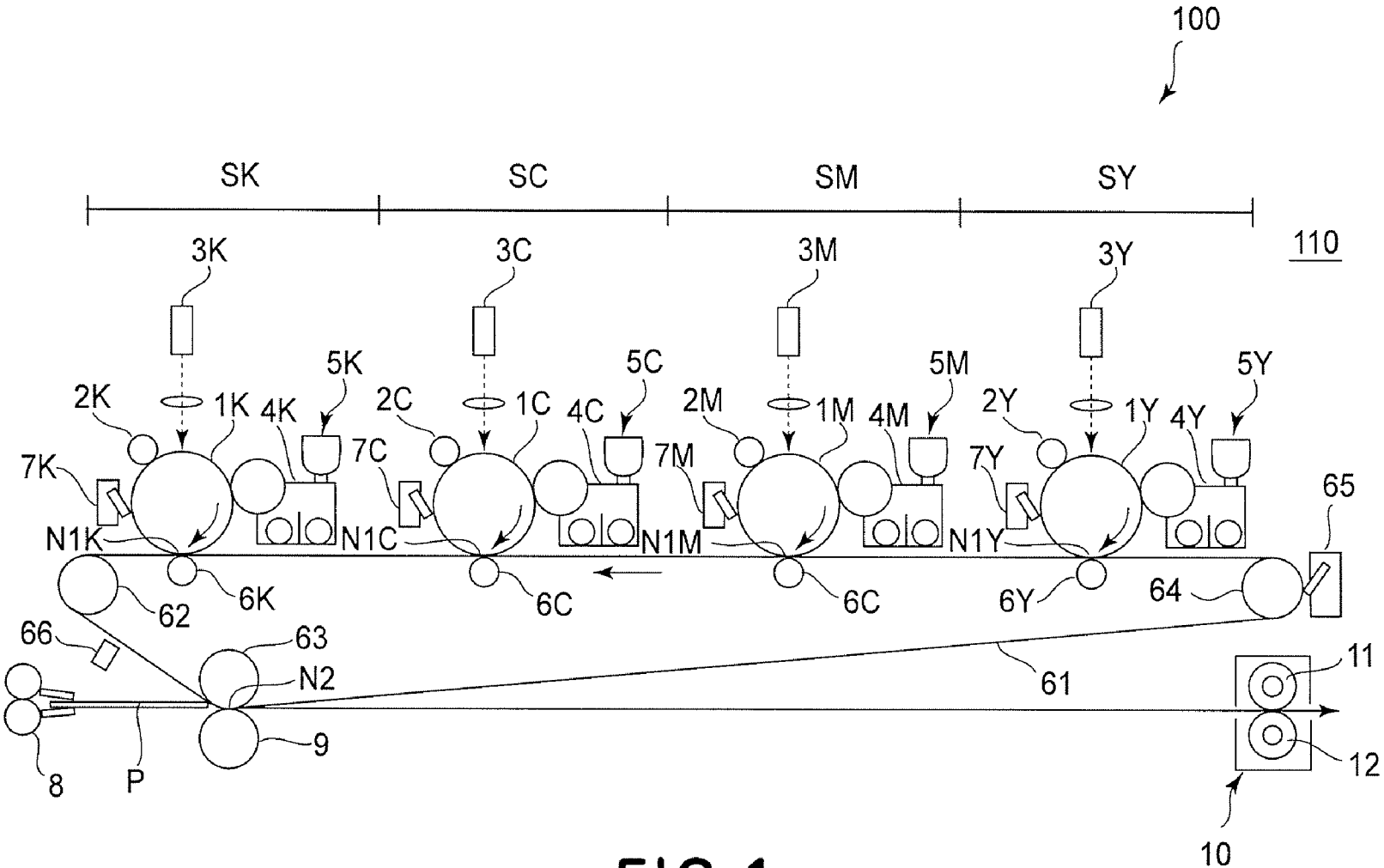
FIG. 1 is a schematic sectional view of the image forming apparatus in the first embodiment of the present invention, showing the general structure thereof.

First, the general structure and operation of the image forming apparatus in this embodiment of the present invention will be described. FIG. 1 is a schematic sectional view of the image forming apparatus 100 in this embodiment, showing the general structure thereof. The image forming apparatus 100 is a full-color laser beam printer, which is capable of forming a full-color image on recording medium (recording paper, plastic film, fabric, etc.) in response to picture signals with the use of an electrophotographic method. The picture signals are sent to the main assembly 110 of the image forming apparatus 100 from a host device, such as an apparatus for reading an original, a personal computer, etc., connected to the image forming apparatus main assembly 110 (which hereafter may be referred to simply as apparatus main assembly) so that communication is possible between the host device and apparatus main assembly 110. Further, the image forming apparatus 100 in this embodiment is of the tandem type, which has been known among the people in the field of image formation. It employs an intermediary transfer system, which also has been well known among the people in the field of image formation.

The image forming apparatus 100 in this embodiment has multiple image forming portions, namely, the first to fourth image forming portions SY, SM, SC, and SK, respectively. The image forming portions SY, SM, SC, and SK are for forming images of yellow (Y), magenta (M), cyan (C), and black (K) colors, respectively. That is, the image forming apparatus 100 forms an image on each of the electrophotographic photosensitive members (photosensitive members) 1Y, 1M, 1C, and 1K, as image bearing members, of the image forming portions SY, SM, SC, and SK, respectively, and transfers (first transfer) the toner images onto an intermediary transfer belt 61, as an intermediary transferring member. Then, the image forming apparatus 100 transfers (second transfer) the toner images on the intermediary transfer belt 61 onto a recording medium P which is being conveyed by a recording medium conveying means.

Incidentally, the four image forming portions SY, SM, SC, and SK with which the image forming apparatus 100 in this embodiment is provided are practically identical in structure, although they are different in the color of the toner in developer. Therefore, when it is unnecessary to differentiate the image forming portions, in terms of developer color (toner color), in the following descriptions of this embodiment, the suffixes Y, M, C, and K for referring to developer color (toner color) will eliminated.

The image forming portion S is provided with the photosensitive member as a cylindrical image bearing member, more specifically, a photosensitive drum 1. The photosensitive drum 1 is rotationally driven in the direction indicated by an arrow mark in FIG. 1. In the adjacencies of the peripheral surface of the photosensitive drum 1, a charge roller 2 as a charging means, a laser scanner 3 (exposing apparatus) as an exposing means, a developing device 4 as a developing means, a first transfer roller 6 as a first transferring means, a drum cleaner as a cleaning means, etc., are disposed. The exposing means 3 is located in the area above the photosensitive drum 1 in FIG. 1. There is also located the intermediary transfer belt 61 as an intermediary transferring member, which opposes the photosensitive drum 1 of the image forming portion S.

The intermediary transfer belt 61 is stretched around multiple belt supporting members, more specifically, a drive roller 62, a backup roller 63 which opposes a second transfer roller, and a follower roller 64, being supported by the rollers. The intermediary transfer belt 61 is circularly moved in the direction indicated by an arrow mark in FIG. 1 by the driving force transmitted to the drive roller 62. The first transfer roller 6 is positioned so that it opposes the photosensitive drum 1 in the image forming portion S. It is in contact with the inward surface of the intermediary transfer belt 61, and keeps the intermediary transfer belt 61 pressured toward the photosensitive drum 1, forming a first transfer portion N1 (first transfer nip), that is, the contact area between the intermediary transfer belt 61 and photosensitive drum 1. The backup roller 63 is positioned so that it opposes a second transfer roller 9 as a second transferring member. The second transfer roller 9 is kept pressed upon the outward surface of the intermediary transfer belt 61, forming a second transfer portion N2 (second transfer nip).

As an image forming operation is started, the peripheral surface of the rotating photosensitive drum 1 is uniformly charged by the charge roller 2. During this step, charge bias is applied to the charge roller 2 from a charge bias power source (unshown). Then, the photosensitive drum 1 is scanned by (exposed to) a beam of laser light emitted from the exposing apparatus 3 while being modulated with picture signals. As a result, an electrostatic image (latent image), which corresponds to the picture signals, is formed on the photosensitive drum 1. The electrostatic image formed on the photosensitive drum 1 is developed by the toner stored in the developing device 4, into a visible image (image formed of toner, or toner image). In this embodiment, the reversal developing method is used, which adheres toner to the points of the peripheral surface of the photosensitive drum 1 exposed by the beam of laser light (points with reduced potential).

The toner image formed on the photosensitive drum 1 is transferred (first transfer) onto the intermediary transfer belt 61 by the function of the first transfer roller 6. In this step, first transfer bias is applied to the first transfer roller 6 from a first transfer bias power source (unshown). The toner remaining on the peripheral surface of the photosensitive drum 1 after the first transfer (first transfer residual toner) is removed by the drum cleaner 7, and is recovered.

For example, in an image forming operation for forming a full-color image using four toners different in color, the above-described operational sequence is sequentially carried out in the first to fourth image forming portions SY, SM, SC, and SK. As a result, four toner images different in color are placed in layers on the intermediary transfer belt 61.

Meanwhile, a recording medium P is conveyed to the second transfer portion N2 by a recording medium conveying means, such as a recording medium feeding-and-conveying roller 8, in synchronism with the timing with which a full-color image is effected on the intermediary transfer belt 61, from a recording medium storage cassette (unshown), in which the recording medium P has been stored.

The four toner images, different in color, on the intermediary transfer belt 61 are transferred together (second transfer) onto the recording medium P by the function of the second transfer roller 9. In this step, second transfer bias is applied to the second transfer roller 9 from a second transfer bias power source (unshown).

Next, the recording medium P is conveyed by the recording medium conveying means to a fixing apparatus 10 as a fixing means. The fixing apparatus 10 has a fixation roller 11 (thermal fixing member) which contains a heating means, and a pressure roller 12 (pressure applying member) which is kept pressed upon the fixation roller 12. The recording medium P and the toner images thereon are subjected to heat and pressure by the fixing apparatus 10. As the toner images are subjected to the heat, they are melted and mixed, and then, welded to the recording medium P, turning into a permanent full-color image. Thereafter, the recording medium P is discharged from the apparatus main assembly 110.

The toner remaining on the intermediary transfer belt 61 after the second transfer, that is, the toner which failed to transfer onto the recording medium P in the second transfer portion N2, is removed by an intermediary transfer belt cleaner 65, and is recovered. This concludes the operational sequence for producing a full-color copy.

Incidentally, it is possible to selectively use one or more image forming portions S to form a monochromatic image of a desired toner, or form a multicolor image of two or more desired toners different in color.

[Developing Device and Toner Supplying Apparatus]

Next, referring to FIGS. 2-4, the developing device 4 and toner supplying apparatus 5 will be described. In this embodiment, the developing devices 4 and toner supplying apparatuses 5, with which the image forming portions SY, SM, SC, and SK are provided one for one to develop the electrostatic latent images for yellow, magenta, cyan, and black colors, respectively, are practically identical in structure.

Figure 2:
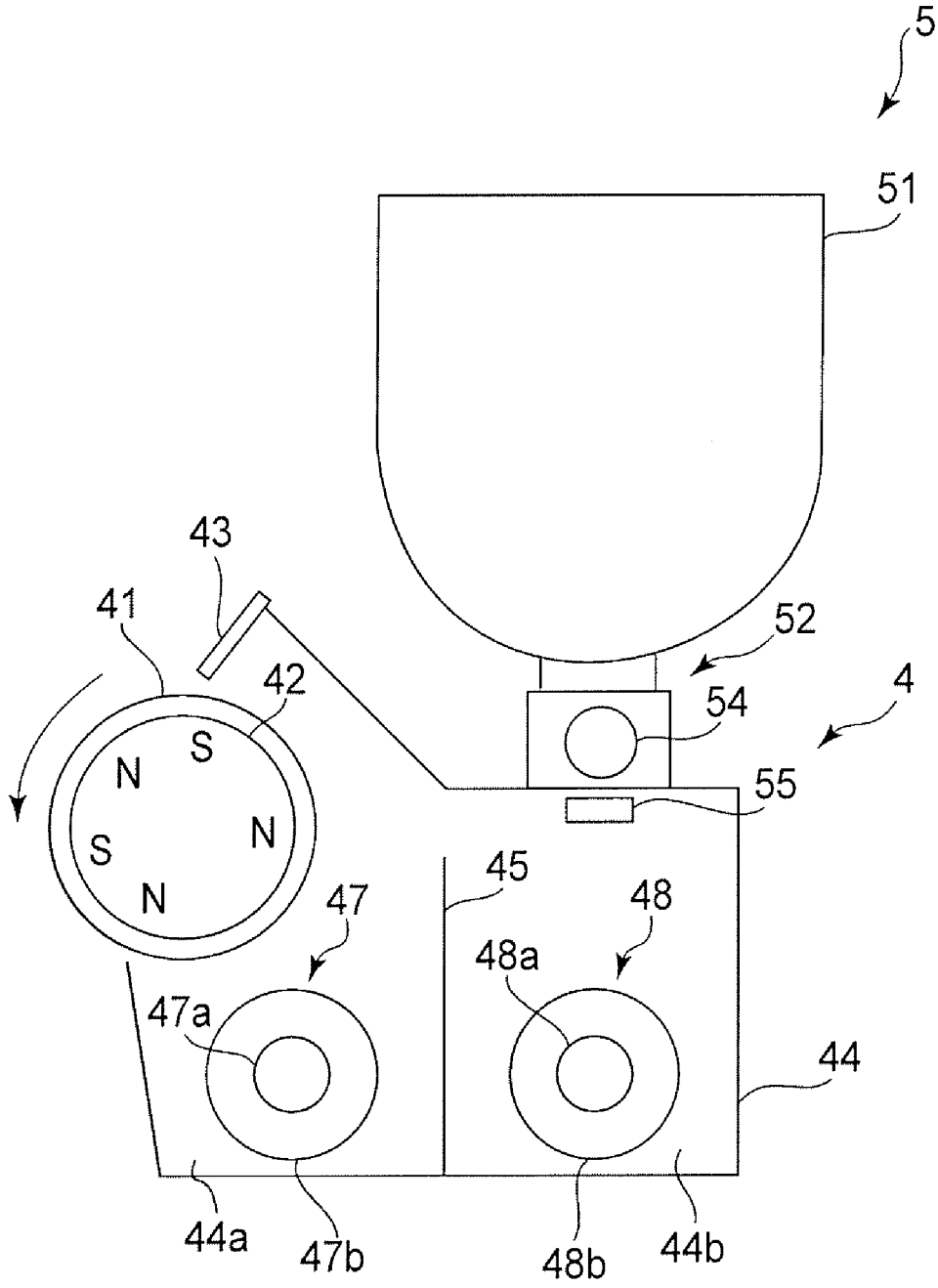
FIG. 2 is a schematic sectional view of the developing apparatus with which the image forming apparatus shown in FIG. 1 is provided.

Referring to FIG. 2, each developing device 4 has a developer container 44 (part of developing device housing) in which developer is stored. In the developer container 44, a two-component developer (developer) made up of essentially nonmagnetic toner particles (toner) and magnetic carrier particles (carrier) is stored. In this embodiment, the initial toner concentration (ratio in weight of toner to total weight of developer) of the developer is 7 percents in weight. However, this value should be adjusted according to the amount of toner charge, carrier particle diameter, image formation apparatus structure, etc.; this value is not mandatory.

The developer container 44 is provided with an opening, which faces the photosensitive drum 1. A development sleeve 41, as a developer bearing member, is rotatably disposed in the developer container 44, being partially exposed through the above-mentioned opening. The development sleeve 41 is made of a nonmagnetic substance, and contains a stationary magnet 42 as a magnetic field generating means. In this embodiment, the magnet 42 has multiple magnetic poles, which are distributed in the circumferential direction. In the developing step, the development sleeve 41 is rotated in the direction indicated by an arrow mark in FIG. 2. As the development sleeve 41 is rotated, it bears a thin layer of the two-component developer in the developer container 44, and conveyed the developer layer to the development area, in which it opposes the photosensitive drum 1. In this embodiment, the development sleeve 41 and photosensitive drum 1 are rotated in such directions that the peripheral surfaces of the development sleeve 41 and photosensitive drum 1 move in the same direction in the development area. The developer borne on the development sleeve 41 forms a magnetic brush, that is, it crests in the form of a brush, in the development area. The magnetic brush is placed in contact, or virtually in contact, with the peripheral surface of the photosensitive drum 1 in order to develop the electrostatic image on the peripheral surface of the photosensitive drum 1 by supplying the toner in the two-component developer layer to the peripheral surface of the photosensitive drum 1 so that the toner adheres to the peripheral surface of the photosensitive drum 1 in the pattern of the electrostatic image on the peripheral surface of the photosensitive drum 1.

Normally, a preset development bias is applied to the development sleeve 41 at least during the development step. As the development bias is applied to the development sleeve 41, the toner on the development sleeve 41 is transferred onto the photosensitive drum 1 by the function of the electric field generated between the photosensitive drum 1 and development sleeve 41 by the development bias. In order to regulate the amount of the developer on the peripheral surface of the development sleeve 41, the developing device 4 is provided with a developer amount regulating means 43 for regulating the thickness of the developer layer on the peripheral surface of the development sleeve 41, on the upstream side of the development area in terms of the rotational direction of the development sleeve 41. The developer layer thickness regulating means 43 works with the magnet 42 to regulate the thickness of the developer layer by the function of the magnetic field.

After the development of the electrostatic image on the photosensitive drum 1, the developer remaining on the development sleeve 41 is further conveyed by the rotation of the development sleeve 41, and is recovered into a development chamber 44*a* (first chamber), as the developer storage portion, of the developer container 44.

Figure 3:
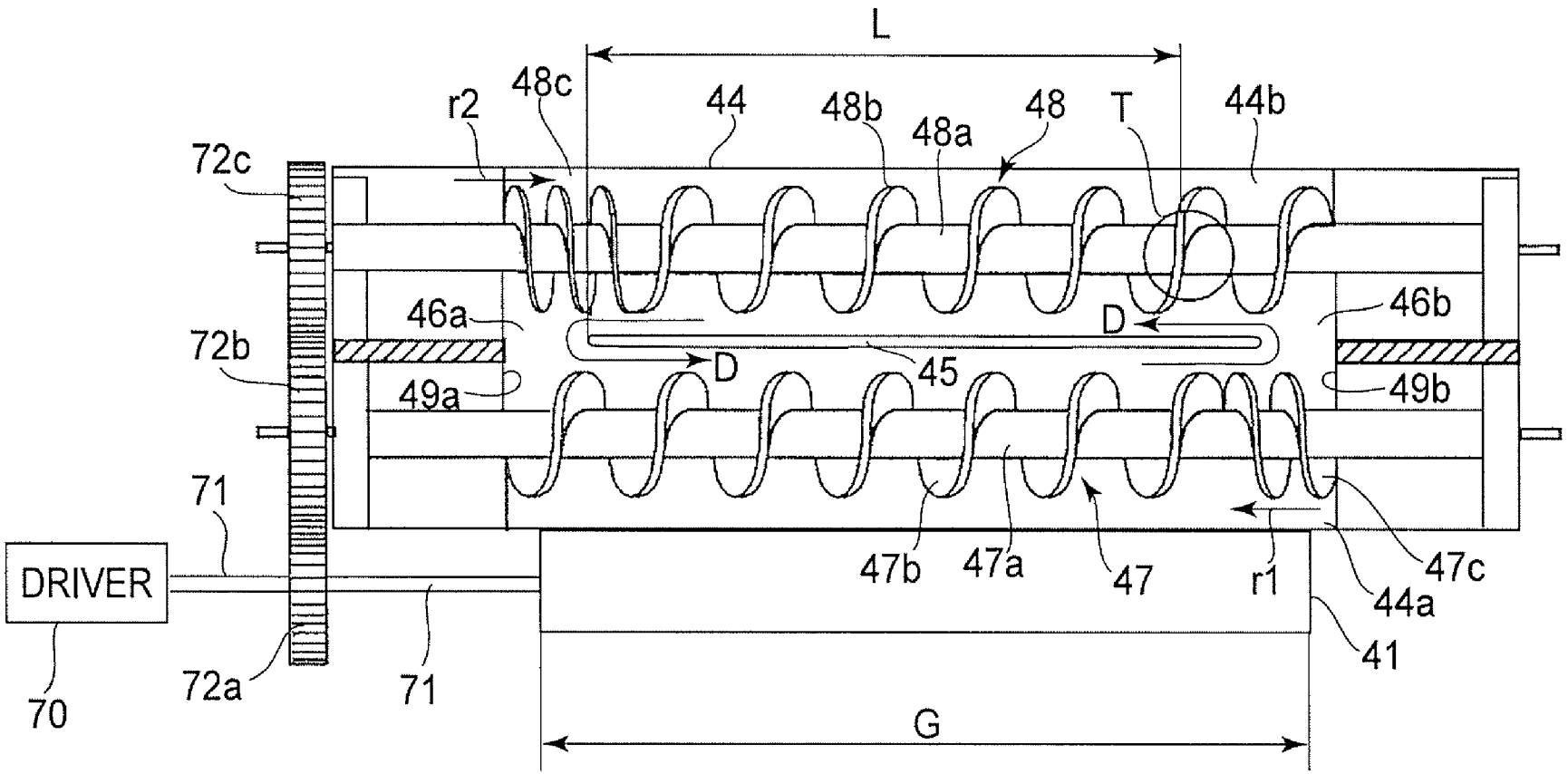
FIG. 3 is a phantom view of the developing apparatus, showing the interior thereof.

Referring to FIG. 3, the internal space of the developer container 44 has two chambers as developer storage portions, that is, the development chamber 44*a* (first chamber) as a developer storage portion, and a stirring chamber 44*b* (second chamber). The two chambers 44*a* and 44*b* are separated by a partitioning wall 45. The chamber which is closer to the development sleeve 41 is the development chamber 44*a*, and the chamber which is farther from the development sleeve 41 is the stirring chamber 44*b*. In this embodiment, the lengthwise directions of the development chamber 44*a* and stirring chamber 44*b* are parallel to the lengthwise direction of the axle of the development sleeve 41. The partitioning wall 45 does not reach the internal walls 49*a* and 49*b* located near the lengthwise end walls of the developer container 44, respectively, providing therefore first and second passages 46*a* and 46*b*, respectively, which allow the developer to move between the development chamber 44*a* and stirring chamber 44*b*.

The developer chamber 44*a* and stirring chamber 44*b* are provided with a developer circulating means for causing the developer to circulate though the two chambers. This circulating means has first and second screws 47 and 48 as developer stirring-and-conveying members, which extend in the development chamber 44*a* and the stirring chamber 44*b*, respectively, in the lengthwise direction of the developer container 44. The developer is circularly conveyed, while being stirred and mixed, through the developer container 44 by the first and second screws 47 and 48. In this embodiment, the direction in which the developer is circulated is such that in the development chamber 44*a*, the developer is moved from the rear side to the front side, in FIG. 2, whereas in the stirring chamber 44*b*, the developer is moved from the front side to the rear side, in FIG. 2 (direction indicated by arrow mark D in FIG. 3).

In this embodiment, the driving force from a driving force source 70 (motor) as a developing device driving means, with which the apparatus main assembly 110 is provided, is transmitted to the development sleeve 41 through a rotational shaft 71 as a driving force transmitting means. This driving force is further transmitted to the first and second screws 47 and 48 through a gear train, as a driving force transmitting means, made up of gears 72*a*, 72*b*, and 72*c*.

In this embodiment, the first and second screws 47 and 48 have rotational shafts 47*a* and 48*a*, which are roughly parallel with the lengthwise directions of the development chamber 44*a* and stirring chamber 44*b*, respectively. The first and second screws 47 and 48 have spiral developer conveying portions 47*b* and 48*b* (wings: spiral members), which are attached to the rotational shafts 47*a* and 48*a*, being spirally wound around the shafts 47*a* and 48*a*, respectively. In this embodiment, the rotational shafts 47*a* and 48*a* are 6 mm in diameter (external diameter). The spiral developer conveying portions 47*b* and 48*b* are 16 mm in diameter, and 15 mm in pitch.

Also in this embodiment, the first and second screws 47 and 48 are provided with first and second spiral blades 47*c* and 48*c*, respectively, which are for pushing back the developer and are located at the downstream ends of the first and second screws 47 and 48, respectively, in terms of the developer conveyance direction. The first and second spiral blades 47*c* and 48*c* are coaxial with the first and second screws 47 and 48, but, are opposite to the first and second screws 47 and 48, in terms of developer conveyance direction (direction indicated by arrow mark D in FIG. 3); in other words, the spiral blades 47*c* and 48*c* push back the developer in the direction opposite to the above-mentioned developer conveyance direction. Therefore, the developer is smoothly moved from the stirring chamber 44*b* into the development chamber 44*a* through the first developer passage 46*a*, and from the development chamber 44*a* into the stirring chamber 44*b* through the second developer passage 46*b*.

The toner in the two-component developer is consumed by a developing operation. Thus, the toner concentration of the developer in the developer container 44 gradually reduces. Therefore, the developer container 44 is supplied with toner by the amount equal to the amount by which toner has been consumed by the development, by the toner supplying apparatus 5, as shown in FIGS. 2 and 4. This process will be described later in detail.

In this embodiment, the toner supplying apparatus 5 has a toner container 51 as a toner supply storage portion (toner supply vat: toner storage portion), and toner supplying mechanism 52 as a toner supplying means which delivers the toner in the toner container 51 to the developer container 44.

The toner container 51 holds the toner to be supplied to the developing device 4. It may be rendered removably attachable to the apparatus main assembly 110, more specifically, the toner supplying mechanism 52, or it may be solidly attached to the apparatus main assembly 110.

The toner supplying mechanism 52 has a toner conveyance passage 53, which is connected to the toner container 51. The toner conveyance passage 53 is roughly straight and cylindrical. It is positioned so that its axial line is roughly in parallel with the horizontal plane, provided that the apparatus main assembly 110 is horizontally set.

The toner conveyance passage 51 is provided with an opening 53*a*, which is located at one end of the toner conveyance passage 51 in terms of the axial direction and faces upward. The toner is delivered from the toner container 51 to the toner conveyance passage 53 through this opening 53*a*. In this embodiment, the toner is delivered to the toner conveyance passage 53 from the toner container 51 by allowing the toner to free fall into the toner conveyance passage 53. However, this embodiment is not intended to limit the present invention in scope. For example, the toner supplying mechanism 52 may be provided with a drivable toner delivering means dedicated to the delivery of toner from the toner container 51 to the toner conveyance passage 53. Further, the toner conveyance passage 53 is provided with a toner outlet 55, which is located other end of the toner conveyance passage 53 and opens downward. The toner outlet 55 is connected to the toner inlet T (FIG. 3), with which the developer container 44 is provided, and through which the internal space of the toner conveyance passage 53 is connected to the internal space of the developer container 44.

The toner supplying mechanism 52 has a toner supplying screw 54 as a toner conveying member, which is in the toner conveyance passage 53. The toner delivered from the toner container 51 to the toner conveyance passage 53 is conveyed toward the toner outlet 55 by the toner supplying screw 54. The toner supplying screw 54 is rotationally driven by a driving force source 56 (motor) as a toner supplying mechanism driving means. The rotation of the motor 56 is controlled by a CPU 81 as a controlling means with which the apparatus main assembly 110 is provided.

The toner supplying apparatus 5 is structured so that when the apparatus main assembly 110 is typically set, that is, horizontally set, the number of the rotations of the toner supplying screw 54 is practically proportional to the amount by which toner is delivered (amount by which developer container 44 is supplied with toner), and also, so that when the apparatus main assembly 110 is typically set, that is, horizontally set, the rotational speed of the toner supplying screw 54 is practically proportional to the amount by which toner is delivered (supplied) to the developer container 44 per unit length of time.

[Toner Delivery Control]

As an image forming operation is repeated, the toner in the developer container 44 is consumed by the operations. As a result, the toner concentration of the developer in the developer container 44 decreases. Thus, it is desired to replenish the developer container 44 with toner, as necessary, so that the toner concentration of the developer in the developer container 44 remains within a preset range.

In this embodiment, the image forming apparatus 100 employs both first and second toner delivery controlling means, which control the toner delivery based on the video count and the density the toner image of the referential patch, respectively. The first toner delivery controlling means (based on video count) controls the length of time the toner supplying screw 54 is rotated, based on the video count of the density signal in picture signals. The second toner delivery controlling means (based on density of referential toner image) controls the length of time the toner supplying screw 54 is rotated, based on the density of the referential toner image. More specifically, first, the referential toner image is formed on the photosensitive drum 1, and is transferred onto the intermediary transfer belt 61. Then, the density of the referential toner image on the intermediary transfer belt 61 is detected by an optical sensor 66 (image density sensor) as a density detecting means (FIG. 1). Then, the density signal from the optical sensor 66, which results from the detection of the density of the referential toner image, is compared with the preset and stored referential signal. Then, the length of time the toner supplying screw 54 is driven, which is determined by the first toner delivery controlling means is adjusted based on the result of the comparison.

First Toner Delivery Controlling Means (Means Based on Video Count)

In this embodiment, primarily, the toner concentration of the developer is controlled using a video counting system. In the video count system, the level of each output signal of the picture signal processing circuit is measured, and is accumulated for the total number of picture elements for the size of an original, obtaining thereby the cumulative picture signal levels per original. For example, when an original of A4 size is copied at 400 dpi and with 256 levels of gradations in tone, the maximum cumulative picture signal level is $3884\times10^6$.

The video count corresponds to the expected amount of toner consumption. Therefore, the proper length of time the toner supplying screw 54 is to be rotated can be determined from a conversion table which shows the relationship between the video count and the length of time the toner supplying screw 54 needs to be rotated. Then the toner supplying screw 54 is rotated for the thus determined length of time to deliver toner from the toner supplying mechanism 52 to developer container 44.

The above-mentioned conversion table is stored in advance in a ROM 82 as a storage means. It is from this conversion table that the length of time the toner supplying screw 54 need to be rotated is obtained by the CPU 81 as a controlling means. The CPU 81 controls the driving of the motor 56, based on the obtained length of time the toner supplying screw 54 needs to be rotated, as will be described next.

It should be noted here that in this embodiment, the length of time the toner supplying screw 54 is to be rotated is selected from among only the values obtainable by multiplying the preset unit length of time by integers (unit (block) delivery).

Figure 5:
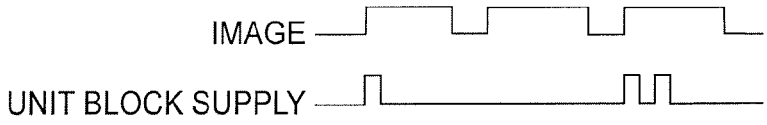
FIG. 5 is a timing chart of an example of an operation for supplying the developing apparatus with toner so that toner is delivered in units to the developing apparatus, with proper intervals.

FIG. 5 is a timing chart of an example of a toner delivery operation in which toner is delivered in units (blocks). More specifically, in this embodiment, the length of time the toner supplying screw 54 is to be rotated to deliver a unit (block) of toner is 0.4 seconds. Thus, the length of time the toner supplying screw 54 is rotated per image is limited to 0.4 seconds or one of the values obtainable by multiplying 0.4 seconds by integers.

For example, if the length of time the toner supplying screw 54 is to be rotated based on the above-mentioned video count and conversion table is 0.52 seconds, the number of units (blocks) of toner to be supplied to the developer container 44 per image is one. That is, in this case, the length of time the toner supplying screw 54 is to be rotated is set to 0.4 seconds, and the rest, or 0.12 seconds, is stored, as an excess length of time, in a RAM 83, and is added to the length of time the toner supplying screw 54 is to be rotated based on the next video count and conversion table.

Figure 6:
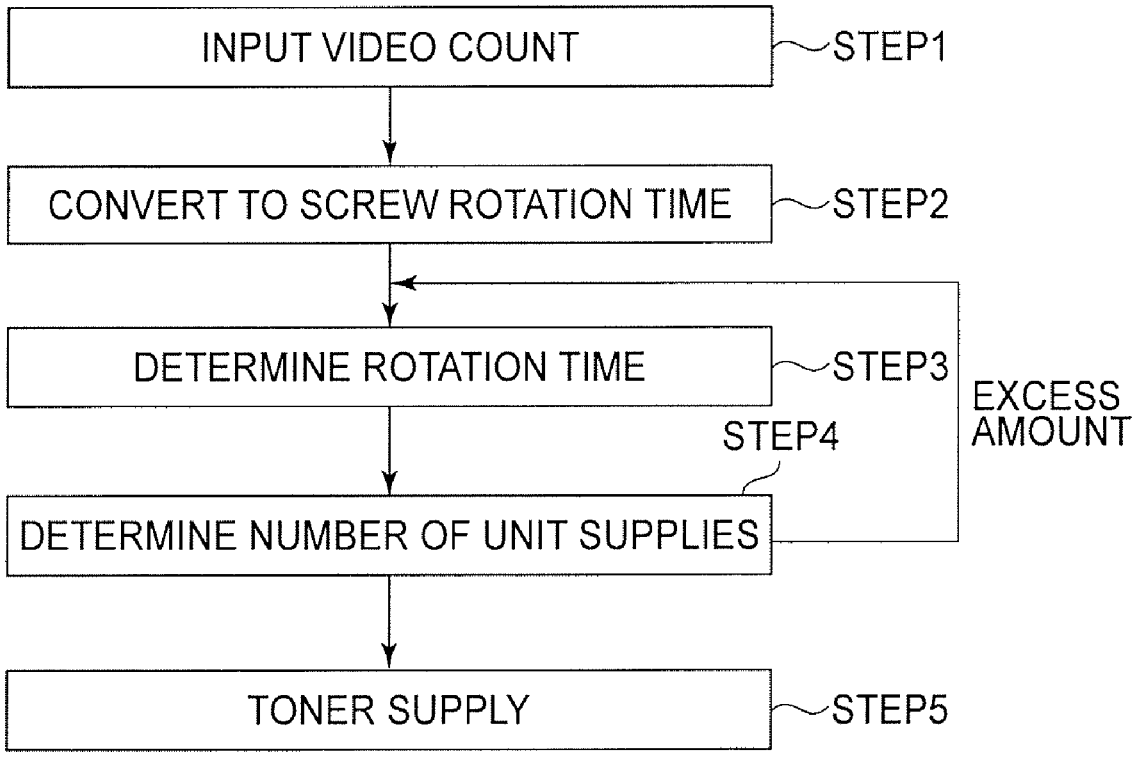
FIG. 6 is a flowchart of a toner supplying operation controlled based on the video count.

FIG. 6 is a flowchart of the above-described toner delivery control based on the video count. As the video count is inputted into the CPU 81 (Step 1), the CPU obtains the length of time the toner supplying screw 54 needs to be rotated, by referring to the conversion table stored in the ROM 82 (Step 2). Then, if the CPU 81 detects, in the RAM 83, the remainder (excess) of the theoretical length of time the toner supplying screw 54 should have been rotated in preceding toner supplying rotation of the toner supplying screw 54, according to the video count and conversion table, the CPU 81 adds the remainder to the length of time the toner supplying screw 54 is to be rotated, which was obtained in Step 2 (Step 3). Then, the CPU 81 determines the number of units (blocks) of toner, which must be delivered (supplied) to the developer container 44 in the following image forming operation, based on the length of time the toner supplying screw 54 needs to be rotated, which was determined in Step 3, and the length of time the toner supplying screw 54 needs to be rotated to deliver a unit (block) of toner (Step 4). Then, the CPU 81 sends control signals to the motor 56 so that the toner supplying screw 54 is rotated for the length of time necessary to deliver (supply) the determined number of units (blocks) of toner; the developer container 44 is supplied with toner (Step 5). If the theoretical length of time the toner supplying screw 54 is to be rotated, which was determined in Step 3, is longer than the length of time the toner supplying screw 54 needs to be rotated to convey the units (blocks) of toner, the number of which was determined in Step 4, the excess time of rotation is stored in the RAM 83.

As one of the merits of limiting the length of time the toner supplying screw 54 is to be rotated, to one of the values obtainable by multiplying by integers the length of time the toner supplying screw 54 needs to rotated to convey a unit (block) of toner, it may be listed that the amount of toner with which the developer container 44 is supplied per toner supplying operation is stable.

That is, if toner is supplied by rotating the toner supplying screw 54 for the exact length of time obtained based on the video count, the length of time the toner supplying screw 54 is rotated is extremely short when the video count is small. If the length of time the toner supplying screw 54 is rotated is short, the amount by which toner is supplied is substantially affected by the length of time it takes for the motor 56 for driving the toner supplying screw 54 to start up or completely stop. Therefore, the amount by which toner is supplied is likely to be unstable.

In comparison, when the unit-based (block-based) toner delivery method, such as the one employed in this embodiment, is employed, that is, toner is supplied in a unit (block) or units (blocks) of toner by rotating the toner supplying screw 54 for the length of time which corresponds to the number of units (blocks) of toner which needs to be supplied, the amount by which toner is supplied remains stable.

Second Toner Delivery Controlling Method (Method Based on Density of Toner Image of Patch)

In the case of the toner delivery controlling method based on video count, if there is a discrepancy between the expected amount of toner consumption and the actual amount of toner consumption, the toner concentration of the developer gradually deviates from the proper range. In this embodiment, therefore, the amount by which toner is supplied is adjusted every preset length of time based on the density of the toner image of the referential patch. Hereafter, the operational mode in which the amount by which toner is supplied is adjusted with preset intervals, based on the density of the referential toner image will be referred to simply as "patch detection mode".

In this embodiment, the length of the interval with which the patch detection mode is carried out is set to the value equivalent to 50 copies of small size (A4, for example).

More specifically, as the cumulative copy count reaches 50, that is, as the time for carrying out the patch detection mode arrives, an electrostatic image of the referential image (patch) with a preset size is formed on the peripheral surface of the photosensitive drum 1, and this electrostatic image is developed into a toner image (referential toner image) by applying a preset contract voltage. Then, the referential toner image is transferred onto the intermediary transfer belt 61, and the density of the referential toner image on the intermediary transfer belt 61 is detected by the optical sensor 66 as a density detecting means positioned so that it opposes the intermediary transfer belt 61. The optical sensor 66 has a light emitting portion and a light receiving portion. It projects a beam of light toward the intermediary transfer belt 61 and receives the light reflected by the referential toner image on the intermediary transfer belt 61. It outputs to the CPU 81 a signal which represents the amount of light (amount of reflected light) its light receiving portion received. This signal (which hereafter will be referred to as "density signal") indicates the density (amount of toner having adhered to intermediary transfer belt 61 per unit area) of the toner image, on the intermediary transfer belt 61.

The CPU 81 compares the density signal Vsig, which corresponds to the density of the referential toner image detected by the optical sensor 66, with the preset referential signal Vref stored in advance in the ROM 82.

If Vig−Vref<0, the CPU 81 determines that the density of the referential toner image is insufficient, that is, the toner concentration of the developer is insufficient. Then, from the difference between the Vref and Vsig, the CPU 81 calculates the amount by which toner needs to be supplied, and the corresponding length of time the toner supplying screw 54 needs to be rotated. Then, the CPU 81 adds the determined length of time the toner supplying screw 54 needs to be rotated, to the length of time the toner supplying screw 54 should be rotated based on the video count, in order to adjust the length of time the toner supplying screw 54 needs to be rotated based on the video count.

On the other hand, if Vsig−Vref>0, the CPU 81 determines that the density of the toner image of the patch is excessive, that is, the toner concentration of the developer is excessive. Then, the CPU 81 calculates the excessive amount of toner and the corresponding length of time the toner supplying screw 54 needs to be kept stationary. Then, the CPU 81 subtracts this length of time the toner supplying screw 54 needs to be kept stationary, from the theoretical length of time the toner supplying screw 54 should be rotated according to the video count, in order to adjust the length of time the toner supplying screw 54 needs to be rotated based on the video count.

The deviation of the toner concentration of the developer can be corrected by carrying out an operation such as the one described above.

Figure 7:
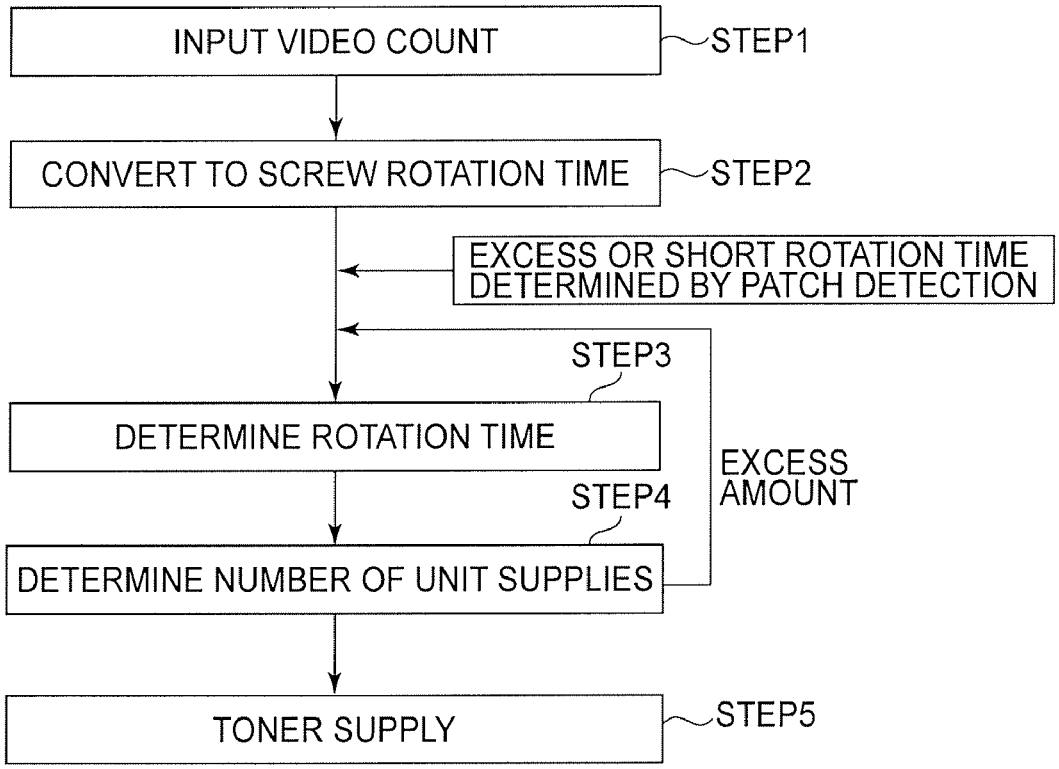
FIG. 7 is a flowchart of a toner supplying operation controlled based on both the video count and the density of the referential toner image.

Given in FIG. 7 is the flowchart of the toner delivery control based on both the video count and density of the toner image of the patch. Steps 1-5 in the flowchart in FIG. 7 are the same as those in the flowchart of the toner delivery control based on the video, which was described with reference to FIG. 6. In the flowchart in FIG. 7, the excess or insufficiency in the length of time the toner supplying screw 54 is to be rotated, which is obtained in the above-mentioned patch detection mode is subtracted or added to the length of time the toner supplying screw 54 needs be rotated, which was obtained in Step 2 (Step 6).

Figure 8:
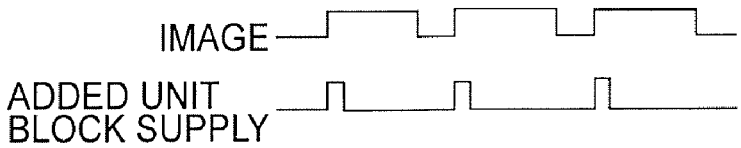
FIG. 8 is a timing chart of a timing chart of an example of a method for supplementing the number of units (blocks) of toner, based on the signal indicating the density of the referential toner image.

In this embodiment, when increasing the length of time the toner supplying screw 54 is rotated, based on the density detected in the patch detection mode, that is, when increasing the number of units (block) by which toner is supplied, the length of time the toner supplying screw 54 is rotated is increased so that the amount of the toner supplied to the developer container 44 is increased by only one unit (block) of toner per image, as shown in FIG. 8.

That is, even if the density detected in the patch detection mode indicates that the developer container 44 needs to be supplied with 10 units (blocks) of toner, the ten blocks of toner are not added all at once. Instead, 10 units (blocks) of toner are delivered (supplied) at a rate of one unit (block) per image. In other words, the adjustment to the length of time the toner supplying screw 54 is to be rotated is completed during the formation of the following 10 copies, one adjustment for each of 10 copies. In other words, how toner is supplied in unit (block) when the level of the signal indicating the density of the referential toner image is no higher than a preset value is different from that when the level of the signal indicating the density of the referential toner is no lower than the preset value.

The above-described control can prevent the problem that the sudden increase of the toner concentration in the developer container 44 causes the formation of an image suffering from fog and/or scattering of toner.

[Developer]

Next, the developer in this embodiment will be described. As described above, in this embodiment, two-component developer made up of essentially nonmagnetic toner particles (toner) and magnetic carrier particles is used.

Each toner particle is made up of bonding resin and coloring agent. The toner may contain coloring resin particles containing internal additives, and coloring particles covered with external additives such as micro particles of colloidal silica. The toner may be made of polyester resin which is negative in native polarity. It can be manufactured by pulverization. The volume average particles diameter of the toner is desired to be no less than 5 μm and no more than 9 μm. The volume average particles diameter of the toner in this embodiment was 6.2 μm.

As the preferable material for the carrier, iron, nickel, cobalt, manganese, chrome, rare-earth metals, alloys of the preceding metals, oxide of ferrite, etc., can be used. The carrier particle surface may be oxidized or unoxidized. There is no restriction regarding the method for manufacturing the magnetic carrier. The weight average particle diameter of the carrier may be in a range of 20-50 μm. It is preferred to be in a range of 30-40 μm. The resistivity of the carrier desired to be no less than $10^7$ Ω·cm. It is preferred to be no less than $10^8$ Ω·cm. The resistivity of the carrier in this embodiment was $10^8$ Ω·cm.

The volume average particle diameter of the toner was measured using the apparatus and method which will be described next. As the measuring apparatus, a Coulter Counter TA-II (product of Coulter Co., Ltd.) was used in combination with an interface (product of Nikkaki) for outputting the number average distribution and volume average distribution, and a personal computer CX-I (product of Canon Inc.). As the electrolyte, 1% water solution of NaC1 concocted using first class sodium chloride was used. The measuring method was as follows. That is, to 100-150 ml of the above-mentioned electrolyte, surfactant, preferably, 0.1 ml of alkylbenzene sulfonate was added, and, 0.5-50mg of the sample to be measured was added to this mixture. Then, the mixture, that is, the electrolyte in which the test sample was suspended, was processed with an ultrasonic dispersing device for about 1-3 minutes to disperse the test sample. Then, the distribution of the particles whose diameter is in a range of 2-40 μm was obtained with the use of the abovementioned Coulter Counter TA-II and a 100 μm aperture. Then, the volume average distribution was obtained from the abovementioned particle size distribution. Then, the volume average particle diameter was obtained from the thus obtained volume average distribution.

[Detection of Angle of Inclination]

Next, the primary feature of this embodiment, which best characterizes the present invention, that is, the method for detecting the inclination angle of the apparatus main assembly 110 and modifying the variable in the toner delivery control, based on the detected inclination angle of the apparatus main assembly 110, will be described.

An image forming apparatus is sometimes set on a tilted surface, and/or used in a place in motion, for example, in a plane. In such a case, the apparatus is used while remaining tilted. If the apparatus is used while remaining tilted, the amount by which toner is supplied to the developer container 44 sometimes becomes unstable. This problem occurs because the tilting of the toner supplying mechanism 52 resulting from the tilting of the apparatus main assembly 110 changes the angle of the toner supplying screw 54 relative to the horizontal plane, which in turn affects the speed at which toner is conveyed by the toner supplying screw 54.

Thus, one of objects of the present invention is to enable the toner supplying mechanism of an image forming apparatus to remain stable in the amount by which it replenish the developing device with toner, even if the main assembly of the image forming apparatus tilts. Another object of the present invention is to keep the toner concentration of the two-component developer stable at a proper level by accomplishing the first object, and make possible an image formation process in which problems such as the change in image density, fog, and scattering of toner, do not occur.

Thus, in this embodiment of the present invention, the rotation of the toner supplying screw 54 is controlled according to the angle of inclination of the apparatus main assembly 110. Next, this control will be described in detail.

Figure 4:
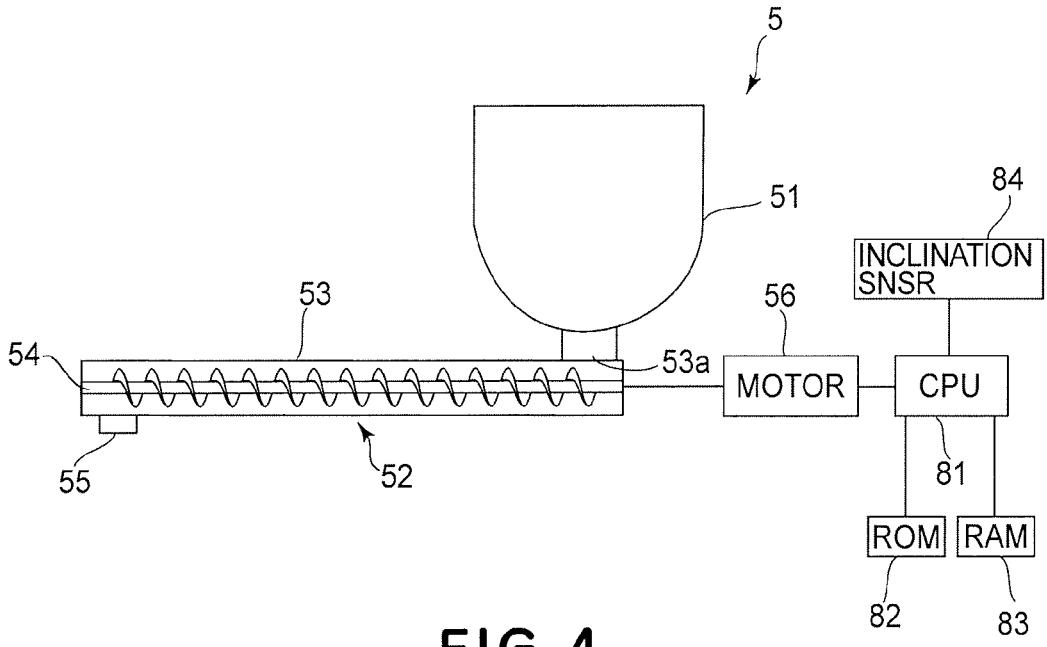
FIG. 4 is a block diagram the toner supplying apparatus structured in accordance with the present invention.

Referring to FIG. 4, in this embodiment, the image fonning apparatus 100 has an inclination angle detection sensor 84, as a means for detecting the inclination angle of an object, for detecting the angle of inclination of the apparatus main assembly 110. The inclination angle detection sensor 84 is fitted inside the apparatus main assembly 110. It is set so that it can detect the inclination angle θ (FIG. 14) of the direction A of the axial line of the toner conveyance passage 53 of the toner supplying mechanism 52, relative to the horizontal plane B. That is, the inclination angle detection sensor 84 is enabled to detect the inclination angle of the toner supplying screw 54 relative to the horizontal plane B. Also in this embodiment, when the apparatus main assembly 110 is on a horizontal surface, the direction A of the axial line of the toner conveyance passage 53 remains parallel with the horizontal plane B. Thus, the above-mentioned angle of inclination θ is equal to the angle of inclination of the apparatus main assembly 110.

Incidentally, in addition to the inclination angle detection sensor 84, there are available various inclination angle detection sensors which detect the inclination angle of the direction of a specific axle of an apparatus, the inclination angle of an object relative to the horizontal plane in any direction (360°), and output an electrical signal which indicates the detected inclination angle of the object. In the present invention, the choice of the inclination angle detection sensor does not need to be limited to the sensor 84; any of the available inclination angle detection sensors may be employed. In this embodiment, an inclination sensor LCF 2000 (product of JEWELL Co., Ltd.) was employed.

The inclination angle detection sensor 84 is connected to the CPU 81 of the apparatus main assembly 110. It remains turned on, continuously detecting the inclination angle θ of the apparatus main assembly 110, as long as the power source of the image forming apparatus 100 is kept turned on.

The relationship between the inclination angle θ detected by the inclination angle detection sensor 84, and the amount (number of units (blocks)) by which toner is supplied to the developer container 44 by each rotation of the toner supplying screw 54, was obtained in advance by experiments or the like.

Figure 9:
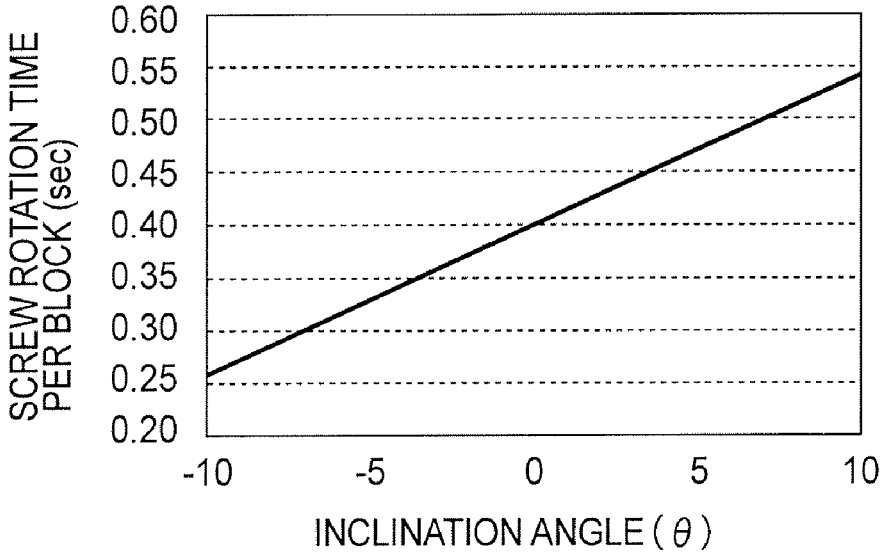
FIG. 9 is a graph showing the relationship between the inclination angle of the main assembly (toner supplying mechanism) of the image forming apparatus, and the length of time the toner supplying screw needs to be rotated to deliver a single unit (block) of toner.

The information which shows the relationship between the inclination angle θ and the length of time of the rotation of the toner supplying screw 54, which is for keeping constant the amount (in unit (block) of toner), is obtained from the results of the above-mentioned experiment, and is stored as a table of data, such as the one shown in FIG. 9, in the ROM 82. Incidentally, this table of data may be stored in the internal storage means of the CPU 81.

The CPU 81 looks up the table of data stored in the ROM 82, and controls the motor 56 according the inclination angle θ detected by the inclination angle detection sensor 84, in order to control the length of time the toner supplying screw 54 is rotated. Therefore, the amount by which the developer container 44 is replenished with toner remains stable regardless of the inclination angle θ of the apparatus main assembly 110.

Figure 14:
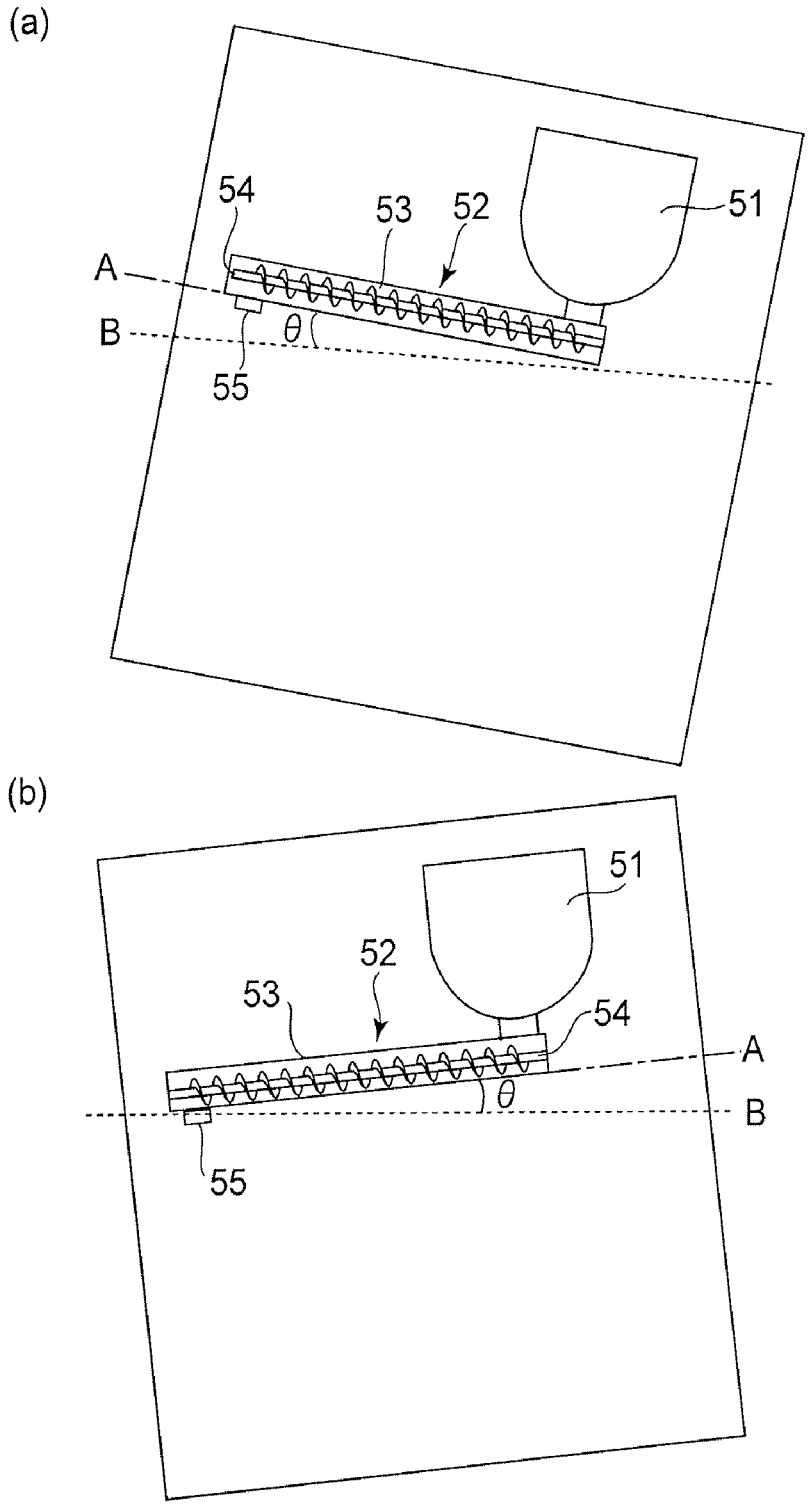
FIG. 14 is a schematic drawing of a toner supplying apparatus, showing the different states of inclination of the image forming apparatus.

To describe further with reference to FIGS. 14(*a*) and 14(*b*), when the lengthwise end of the toner conveyance passage 53, which is provided with the toner outlet 55, is positioned higher relative to the other lengthwise end as shown in FIG. 14(*a*), it is inferred that the inclination angle θ is positive. When the lengthwise end of the toner conveyance passage 53, which is provided with the toner outlet 55, is positioned lower relative to the other lengthwise end as shown in FIG. 14(*b*), it is inferred that the inclination angle θ is negative.

First, when the inclination angle θ is positive (FIG. 14(*a*)), the speed at which the toner is conveyed by the toner supplying mechanism 52 is lower than the normal one. Therefore, control is executed so that the length of time the toner supplying screw 54 rotates becomes longer per unit amount (block) of toner.

On the other hand, when the inclination angle θ is negative as shown in FIG. 14(*b*), the speed at which the toner is conveyed by the toner supplying mechanism 52 is higher than the normal one. Therefore, control is executed so that the length of time the toner supplying screw 54 becomes shorter per unit amount (block) of toner.

The table of data, such as the one shown in FIG. 9, which shows the relationship between the inclination angle θ and the length of time the toner supplying screw 54 needs to be rotated to deliver a preset amount of toner at a preset rotational speed (250 rpm in this embodiment), is stored in the ROM 82. Therefore, the CPU 81 can obtain the length of time the toner supplying screw 54 needs to rotate to deliver the necessary units (blocks) of toner, from the signal which is inputted from the inclination angle detection sensor 84 and indicates the inclination angle θ, by referring to the table of data stored in the ROM 82.

Then, the CPU 81 uses the thus obtained length of time as the length of time the toner supplying screw 54 needs to be rotated in place of the length of time determined in Step 4 of the toner delivery control described with reference to FIGS. 6 and 7. Therefore, the amount (in units (blocks)) by which toner is supplied remains stable regardless of the change in inclination angle θ.

In this embodiment, the length of time the toner supplying screw 54 is rotated is controlled according to the inclination angle θ of the apparatus main assembly 110 as described above. Therefore, the amount by which the developer container 44 is replenished with toner remains stable. Therefore, the toner concentration of the two-component developer remains stable, making possible an image formation process in which the problems such as the changes in image density, fog, scattering of toner, etc., do not occur.

Embodiment 2

Next, another embodiment of the present invention will be described. The basic structure and operation of the image forming apparatus in this embodiment are the same as those in the first embodiment. Thus, the items of the image forming apparatus in this embodiment, which are equivalent in function and structure to those in the first embodiment, are given the same referential symbols as those given to the corresponding ones in the first embodiment, and will not be described in detail. What will be described next are the features of the image forming apparatus in this embodiment, which best characterizes this embodiment.

In the first embodiment, the amount by which toner is supplied is stabilized by controlling the length of time the toner supplying screw 54 is rotated, according to the inclination angle θ of the apparatus main assembly 110. In this embodiment, instead, the rotational speed of the toner supplying screw 54 is controlled according to the inclination angle θ of the apparatus main assembly 110.

Figure 10:
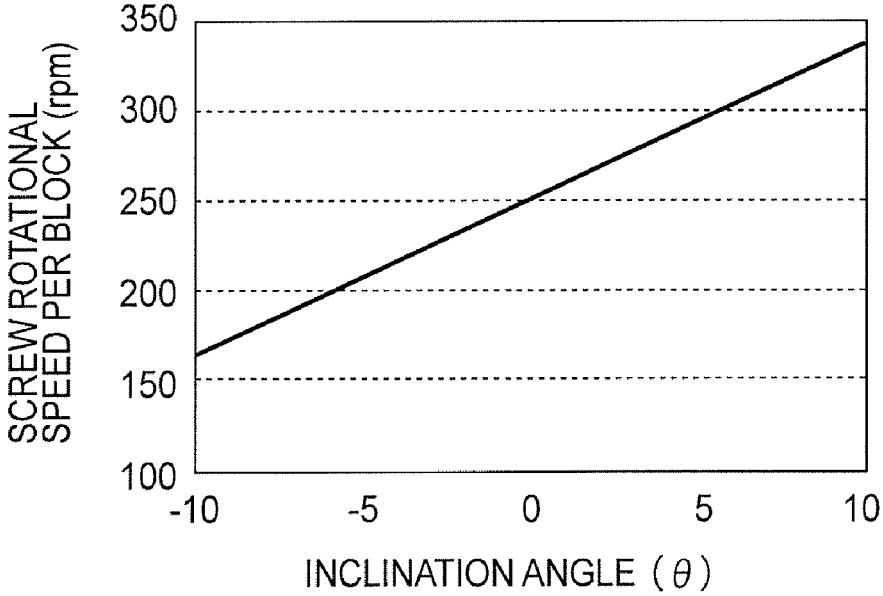
FIG. 10 is a graph showing the relationship between the inclination angle of the main assembly (toner supplying mechanism) of the image forming apparatus, and the rotational speed at which the toner supplying screw needs to be rotated to deliver a single unit (block) of toner.

In this embodiment, the information which shows the relationship between the inclination angle θ of the apparatus main assembly 110 and the rotational speed of the toner supplying screw 54 for keeping constant the amount (number of units (blocks)) by which toner is supplied, is stored in the form of a table of data, such as the one shown in FIG. 10, in the ROM 82. Incidentally, this table of data may be stored in the internal storage means of the CPU 81.

The CPU 81 looks up the table of data stored in the ROM 82, and controls the motor 56 according to the inclination angle θ detected by the inclination angle detection sensor 84, in order to control the rotational speed of the toner supplying screw 54. Therefore, the amount by which the developer container 44 is replenished with toner remains stable regardless of the inclination angle θ of the apparatus main assembly 110.

To further describe this control with reference to FIGS. 14(*a*) and 14(*b*), when the inclination angle θ is positive (FIG. 14(*a*)), the speed at which the toner is conveyed by the toner supplying mechanism 52 is lower than the normal one. Therefore, control is executed so that the rotational speed of the toner supplying screw 54 increases per unit amount (block) of toner.

On the other hand, when the inclination angle θ is negative as shown in FIG. 14(*b*), the speed at which the toner is conveyed by the toner supplying mechanism 52 is higher than the normal one. Therefore, control is executed so that the rotational speed of the toner supplying screw 54 decreases per unit mount (block) of toner.

The table of data, such as the one shown in FIG. 10, which shows the relationship between the inclination angle θ and the rotational speed at which the toner supplying screw 54 needs to be rotated to deliver a preset amount of toner in a preset length of time (0.4 sec in this embodiment), is stored in the ROM 82. Therefore, the CPU 81 can obtain the rotational speed at which the toner supplying screw 54 needs to rotated to deliver the necessary units (blocks) of toner, from the signal which is inputted from the inclination angle detection sensor 84 and indicates the inclination angle θ, by referring to the table of data stored in the ROM 82.

Then, the CPU 81 uses the thus obtained rotational speed as the rotational speed at which the toner supplying screw 54 needs to be rotated, in place of the necessary rotational speed determined in Step 4 (FIGS. 6 and 7) of the toner delivery control described with reference to FIGS. 6 and 7. Therefore, the amount (number of units (blocks) by which toner is supplied remains stable regardless of the change in inclination angle θ.

In this embodiment, the rotational speed at which the toner supplying screw 54 is rotated is controlled according to the inclination angle θ of the apparatus main assembly 110 as described above. Therefore, the amount by which the developer container 44 is replenished with toner remains stable. Therefore, the toner concentration of the two-component developer remains stable, making possible an image formation process in which problems such as the changes in image density, fog, scattering of toner, etc., do not occur.

Embodiment 3

Next, another embodiment of the present invention will be described. The basic structure and operation of the image forming apparatus in this embodiment are the same as those in the first embodiment. Thus, the items of the image forming apparatus in this embodiment, which are equivalent in function and structure to those in the first embodiment, are given the same referential symbols as those given to the corresponding ones in the first embodiment, and will not be described in detail. What will be described next are the characteristic features of the image forming apparatus in this embodiment.

Figure 11:
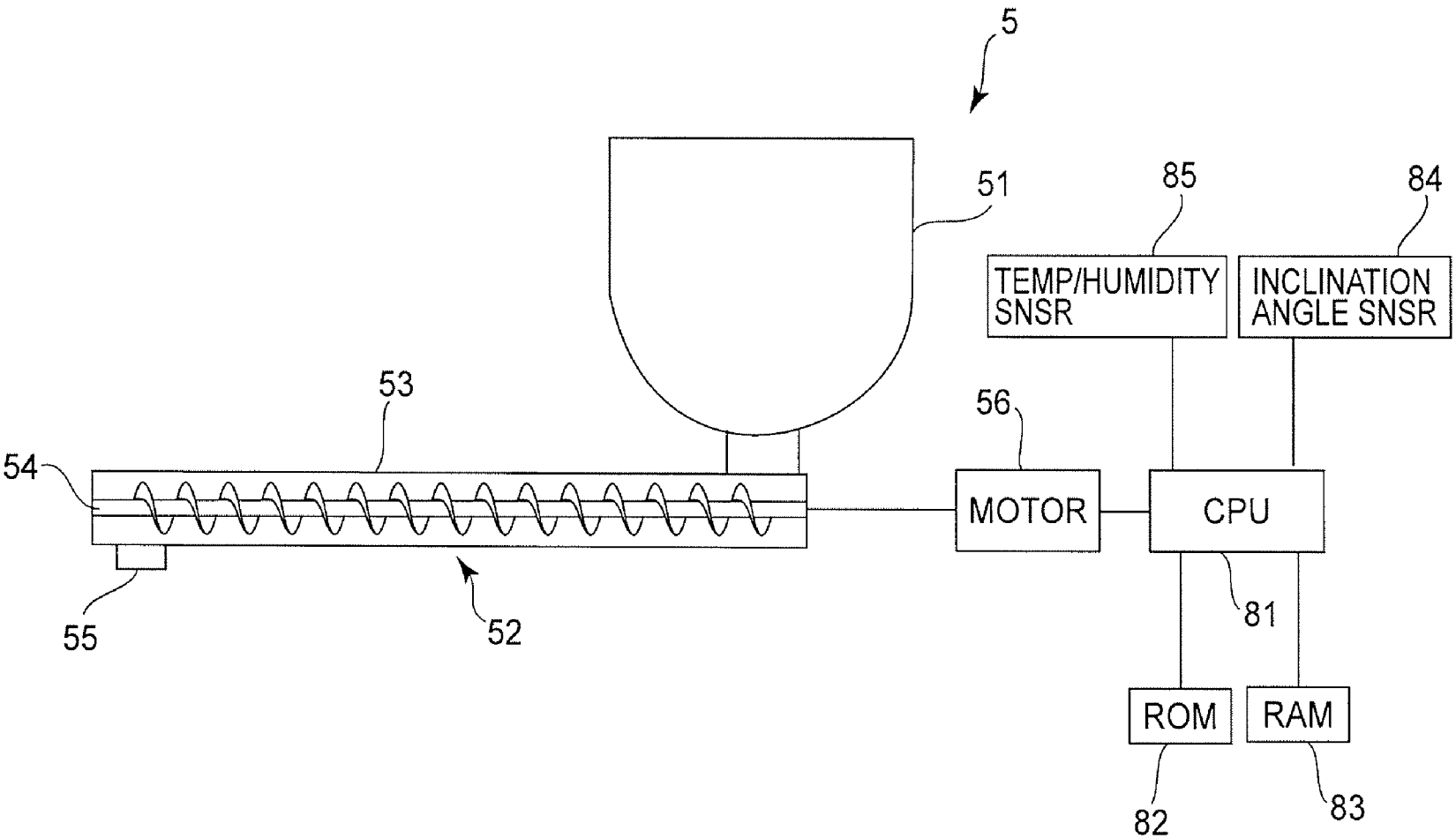
FIG. 11 is a block diagram of the toner supplying apparatus in accordance with the present invention, in another embodiment of the present invention.

Referring to FIG. 11, in this embodiment, the image forming apparatus 100 is provided with a temperature-and-humidity sensor 85 as an ambient condition detecting means which detects the ambient condition of the apparatus main assembly 110. The temperature-and-humidity sensor 85 is a part of the apparatus main assembly 110. The image forming apparatus 100 is also provided with the inclination angle detection sensor 84 as an inclination angle detecting means as is the image forming apparatus 100 in the first and second embodiments. In this embodiment, therefore, the length of time the toner supplying screw 54 needs to be rotated is determined based on both the absolute humidity (absolute amount of humidity) detected by the temperature-and-humidity sensor 85, and the inclination angle θ of the apparatus main assembly 110 detected by the inclination angle detection sensor 84.

To describe in more detail, the toner concentration of the two-component developer can be kept stable by keeping constant the amount by which the developer container 44 is replenished with toner, by controlling the length of time the toner supplying screw 54 is rotated or the rotational speed at which the toner supplying screw 54 is rotated, according to the inclination angle θ of the apparatus main assembly 110, as in the first and second embodiment. However, if the toner in the image forming apparatus, which is being used while remaining tilted, changes in fluidity due to the change in the ambient condition in which the image forming apparatus is being used, it is possible that the level of precision at which toner is supplied will become unstable.

Generally, the lower the humidity, the higher the fluidity of toner. Thus, the lower the humidity, the more likely to become unstable the amount by which the developer container 44 is replenished with toner, as the image forming apparatus 100 becomes tilted.

In this embodiment, therefore, the lower the humidity, the greater the amount by which adjustment is made to the length of time the toner supplying screw 54 is rotated to replenish the developer container 44 with toner when it is detected that the apparatus main assembly 110 is tilted.

Figure 12:
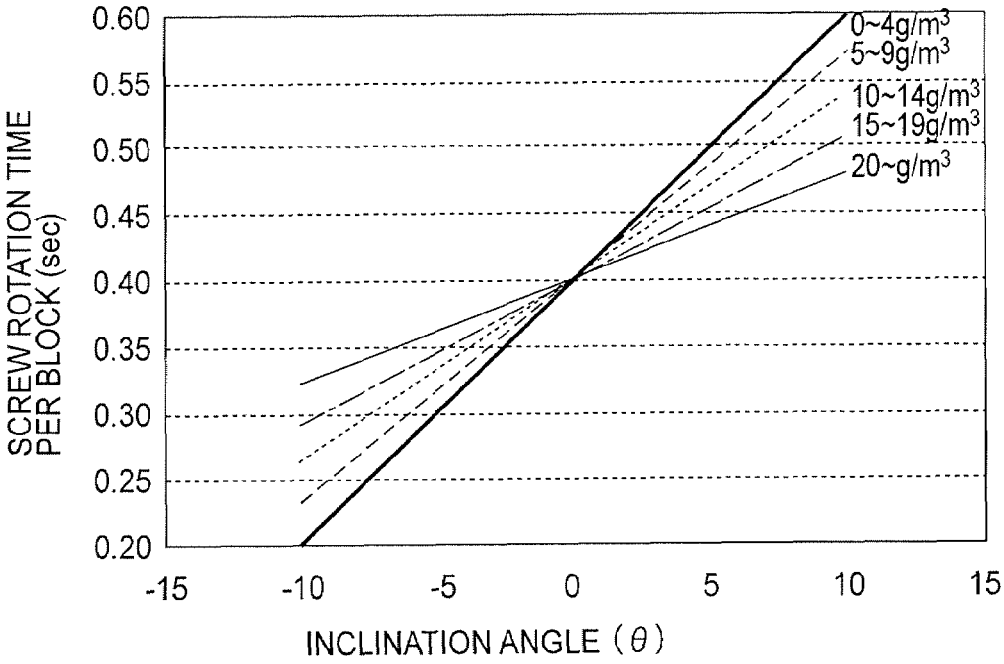
FIG. 12 is a graph showing the relationship among the inclination angle of the main assembly (toner supplying mechanism) of the image forming apparatus, the length of time the toner supplying screw needs to be rotated to deliver a single unit (block) of toner, and the absolute humidity of the developer.
Figure 13:
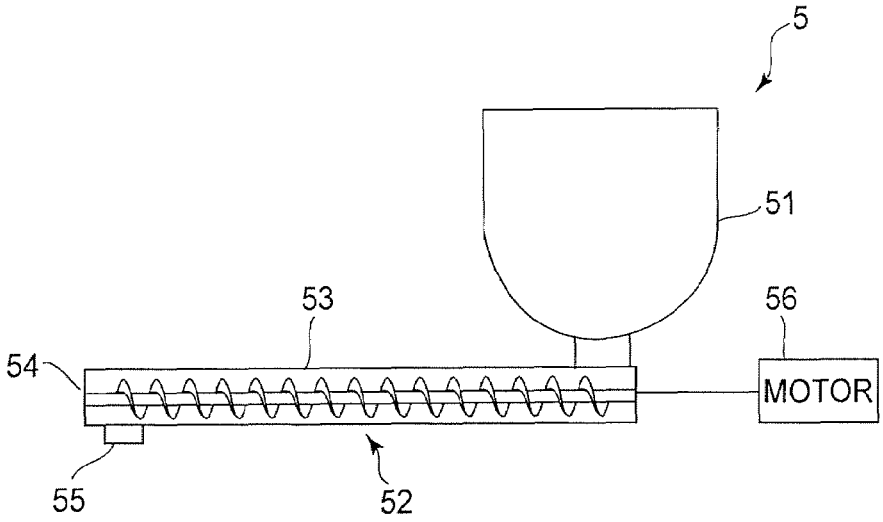
FIG. 13 is a block diagram of an example of a toner supplying apparatus in accordance with the prior art.

In this embodiment, the information regarding the relationship between the inclination angle θ, length of time the toner supplying screw 54 needs to be rotated to compensate for the inclination angle θ, and the relationship between the absolute humidity of the ambient condition of the image forming apparatus, and the length of time the toner supplying screw 54 needs to be rotated to compensate for the inclination angel θ, is store in the form of a table of date, such as the one shown in FIG. 12, is store in the ROM 82. Incidentally, this table of data may be store in the internal storage means of the CPU 81.

The CPU 81 looks up the table of data stored in the ROM 82, and controls the motor 56 according the absolute humidity detected by the temperature-and-humidity sensor 85, and the inclination angle θ detected by the inclination angle detection sensor 84, in order to control the length of time the toner supplying screw 54 is rotated. Therefore, the amount by which the developer container 44 is replenished with toner remains stable regardless of the absolute ambient humidity and inclination angle θ of the apparatus main assembly 110.

To further describe this control with reference to FIGS. 14(*a*) and 14(*b*), when the inclination angle θ is positive (FIG. 14(*a*)), the speed at which the toner is conveyed by the toner supplying mechanism 52 is lower than the normal one. Therefore a control is executed to increase the length of time the toner supplying screw 54 is rotated per unit (block) of toner.

On the other hand, when the inclination angle θ is negative as shown in FIG. 14(*b*), the speed at which the toner is conveyed by the toner supplying mechanism 52 is higher than the normal one. Therefore, a control is executed to reduce the length of time the toner supplying screw 54 is rotated per unit (block) of toner.

The table of data, such as the one shown in FIG. 12, which shows the relationship between the inclination angle θ and the length of time the toner supplying screw 54 needs to be rotated to deliver a preset amount of toner at a preset rotational speed (250 rpm in this embodiment), and the relationship between the absolute humidity of the ambient condition of the image forming apparatus, and the length of time the toner supplying screw 54 needs to be rotated to deliver the correct number of units (blocks) of toner, is stored in the ROM 82. Therefore, the CPU 81 can obtain the length of time the toner supplying screw 54 needs to rotated to deliver the necessary units (blocks) of toner, from the signal which is inputted from the temperature-and-humidity sensor 85 and indicates the absolute humidity of the ambient condition of the apparatus main assembly 110, and the signal which is inputted from the inclination angle detection sensor 84 and indicates the inclination angle θ, by referring to the table of data stored in the ROM 82.

Then, the CPU 81 uses the thus obtained length of time as the length of time the toner supplying screw 54 needs to be rotated to convey a single unit (block) of toner, when the CPU 81 rotates the toner supplying screw 54 to convey the units (blocks) of toner, the number of which is determined in Step 4 in the toner replenishment control sequence described with reference to FIGS. 6 and 7. Therefore, the amount (in units (blocks)) by which toner is supplied remains stable regardless of the change in the absolute ambient humidity of the apparatus ambient condition, and inclination angle θ.

In this embodiment, the amount by which the length of time the toner supplying screw 54 is rotated is compensated when it is detected that the apparatus main assembly 110 is inclined, is increased in inverse proportion to the ambient humidity of the apparatus, that is, the lower the humidity, the greater the compensation. Therefore, the amount by which the developer container 44 is replenished with toner remains stable. Therefore, the toner concentration of the two-component developer remains stable, regardless of the ambient condition in which the apparatus main assembly 110 is used, making possible an image formation process in which problems such as the change in image density, fog, scattering of toner, etc., do not occur.

Incidentally, in this embodiment, the length of time the toner supplying screw 54 is rotated to convey a single unit (block) of toner is adjusted as was done in the first embodiment. However, the adjustment does not need to be limited to the length of time the toner supplying screw 54 is rotated. For example, the same effects as those obtained in this embodiment can be obtained by adjusting the rotational speed of the toner supplying screw 54, as it was in the second embodiment.

Embodiment 4

Next, another embodiment of the present invention will be described. Incidentally, the basic structure and operation of the image forming apparatus in this embodiment are the same as those in the first embodiment. Thus, the items of the image forming apparatus in this embodiment, which are equivalent in function and structure to those in the first embodiment, are given the same referential symbols as those given to the corresponding ones in the first embodiment, and will not be described in detail. What will be described next is the characteristic features of the image forming apparatus in this embodiment.

In this embodiment, the frequency with which the patch detection mode is carried out, that is, the frequency with which the toner image of the referential patch is formed, is controlled according to the detected inclination angle θ of the apparatus main assembly 110.

To describe in more detail, the toner concentration of the two-component developer can be kept stable by keeping constant the amount by which the developer container 44 is replenished with toner, by controlling the length of time the toner supplying screw 54 is rotated or the rotational speed of the toner supplying screw 54, according to the inclination angle θ of the apparatus main assembly 110, as was in the first to third embodiments. It is possible, however, that in some situations in which an image forming apparatus is used, the amount by which the developer container 44 is replenished with toner will be desired to be kept stable at a higher level of precision.

In this embodiment, therefore, not only is the length of time the toner supplying screw 54 is rotated is controlled according to the inclination angle θ of the apparatus main assembly 110 as was in the first embodiment, but also, whether or not the patch detection mode is to be carried out is determined based on the average value of the inclination angles θ of the apparatus main assembly at which copies are made since the patch detection mode was carried out for the last time, and the cumulative number of copies made since the patch detection mode was carried out for the last time. Here, the average value of the inclination angle θ means the average value of the inclination angles θ of the apparatus main assembly, at which multiple copies are made through a continuous sequence of image forming operations. For example, when three copies were made through a continuous image forming operation, and the inclination angles θ of the apparatus main assembly 110, which were detected while the first, second and third copies were made, were 2°, 4°, and 6°, respectively, 4°, or (2+4+6)/3, is the average value of the inclination angles θ.

In this embodiment, the information regarding the relationship between the inclination angle θ, length of time the toner supplying screw 54 needs to be rotated to convey a single unit (block) of toner, is stored in the form of a table of data, such as the one shown in FIG. 9, in the ROM 82, as was in the first embodiment. Incidentally, this table of data may be stored in the internal storage means of the CPU 81.

The CPU 81 controls the motor 56 according to the inclination angle θ detected by the inclination angle detection sensor 84, by referring to the table of data stored in the ROM 82, in order to control the length of time the toner supplying screw 54 is rotated, as it did in the first embodiment. Therefore, the amount by which the developer container 44 is replenished with toner remains stable regardless of the inclination angle θ of the apparatus main assembly 110.

In this embodiment, the length of the interval with which the patch detection mode is to be carried out is set as follows: The CPU 81 calculates the average value θave of the inclination angles θ at which copies are made since the patch detection mode was carried out for the last time. Then, it determines whether or not the patch detection mode is carried out, based on the calculated average value θave and the number K of copies made since the patch detection mode was carried out last time.

Table 1 shows the relationship between the absolute value |θave| of the average value θave of the inclination angles θ and the number K of the copies to be made before the patch detection mode is to be carried out, since the patch detection mode was carried out last time. That is, this table indicates that the greater the average θave, the shorter the patch detection mode interval must be rendered.

TABLE 1

| Inclination angle \|θave\| (degrees) | Integrated No. of sheets to patch detection operation |
|---|---|
| $9 < \|\theta ave\|$ | 20 |
| $6 < \|\theta ave\| \leqq 9$ | 30 |
| $3 < \|\theta ave\| \leqq 6$ | 40 |
| $0 < \|\theta ave\| \leqq 3$ | 50 |

In this embodiment, information (table) such as Table 1 which shows the above-mentioned relationship is stored in the ROM 82. Incidentally, this table may be stored in the internal storage means of the CPU 81. It is based on this table that the CPU determines whether or not the patch detection mode needs to be carried out.

That is, the CPU 81 makes the image forming apparatus carry out the patch detection mode as the integrated number of copies or prints made since the patch detection mode was carried out last time reaches the preset number K, the value of which is given Table 1.

In this embodiment, the timing with which the patch detection mode is carried out is set using a method such as the above-described one. Therefore, the greater the inclination angle θ, the shorter the patch detection mode interval can be made. In other words, in this embodiment, the length of the interval with which the patch detection mode is carried out is set according to how long the image forming apparatus 100 is used in a condition in which it remains tilted, that is, the condition in which errors are likely to occur to the amount of toner replenishment. Therefore, the toner concentration is kept stable at a higher level of precision. More specifically, in this embodiment, the image forming apparatus 100 forms a toner image of the referential patch according to preset picture information and with preset intervals. It has an image density detecting means which detects the density of the toner image of the referential patch on the intermediary transfer belt 61. In this embodiment, this image density detecting means is made up of the optical sensor 66, CPU 81, etc. This image density detecting means changes the frequency with which the toner image of the referential patch is formed, based on the results of detection by the inclination detecting means 84 (inclination angle detection sensor). Also in this embodiment, the greater the average value of the inclination angle of the apparatus main assembly 110 or toner supplying means 52 (toner supplying mechanism) becomes, the higher the frequency of the formation of the toner image of the referential patch is made.

As described above, in this embodiment, not only is the length of time the toner supplying screw 54 is rotated is controlled according to the inclination angle of the apparatus main assembly 110, but also, the interval with which the patch detection mode is carried out is set according to the length of time the image forming apparatus 100 was used while remaining inclined, and the average angle of the inclination of the apparatus main assembly 110, as described above. Therefore, the amount by which the developer container 44 is supplied with toner is kept stable at a higher level of precision, making possible a stable image formation process, that is, an image formation process in which problems such as the change in image density, fog, scattering of toner, etc., do not occur.

In the foregoing discussion, the present invention was described with reference to the preferred embodiments of the present invention. However, it is desired to be understood that the preceding preferred embodiments are not intended to limit the present invention in scope. For example, in each of the preceding embodiments, the toner supplying method in which toner is supplied in blocks is employed to control the amount by which toner is supplied. However, the method for controlling the amount by which toner is supplied does not need to be limited to the one employed in the preceding embodiments. For example, the length of time the toner supplying screw 54 is rotated may be controlled according to the exact length of time which is calculated as the length of time the toner supplying screw 54 needs to be rotated, based on the video count and/or the density of the toner image of the patch. Even if the toner replenishment control method such as the one described above is employed, the present invention is as effectively applicable as it was in the preceding embodiments. In such a case, all that is necessary is to adjust the length of time the toner supplying screw 54 is rotated or the rotational speed of the toner supplying screw 54 so that the amount by which the developer container 44 is supplied with toner becomes the same as the amount by which the developer container 44 is supplied with toner when the apparatus main assembly 110 is set as prescribed (normally, apparatus main assembly 110 is horizontally set). Also in this case, the length of time the toner supplying screw 54 is rotated or the rotational speed of the toner supplying screw 54 are to be adjusted according to the results of detection by the inclination angle detection sensor 84 and/or temperature-and-humidity sensor 85, as was in each of the preceding embodiments.

Also in each of the preceding preferred embodiments, both the video counting system and patch detecting system were used as the means for controlling the toner concentration in the developer container 44. However, the toner concentration controlling means does not need to be limited to these two methods. For example, the toner concentration of the developer in the developer container 44 may be controlled by using such a toner concentration detecting means, as an optical detection system which measures the change in the light reflection of the developer, an inductance detection system which measures the change in the magnetic permeability of the developer, etc. Also in this case, the present invention is applicable as effectively as it was in the preceding embodiments. Incidentally, various toner replenishment control systems, such as the above-mentioned video counting system, patch detection system, optical detecting system, inductance detecting system, etc., may be used alone, or in combination. In the case of the patch detection system, it may be on the image bearing member, or the transfer medium onto which the toner image is transferred, that the concentration of the toner image of the referential patch is detected.

Also in each of the above-described embodiments, the inclination detection means detected the inclination angle of the apparatus main assembly 110. That is, the toner supplying mechanism 52 was solidly aff ached to the apparatus main assembly 110 so that the axial line of the toner conveyance passage 53 of the toner supplying mechanism 52 is parallel with the horizontal plane. Therefore, the detection of the inclination angle of the apparatus main assembly 110 was virtually the same as the detection of the inclination angle of the toner supplying mechanism 52. However, an image forming apparatus may be designed so that the inclination angle detecting means detects the inclination angle of the toner supplying mechanism 52 itself. For example, sometimes, the toner supplying mechanism 52 will have moved relative to the apparatus main assembly 110 in order to supply the toner container 51 with a supply of replenishment toner because of the depletion of the replenishment toner in the toner container 51. In a case such as this, it is possible that the toner supplying mechanism 52 will have inclined relative to the apparatus main assembly 110, being therefore inclined relative to the horizontal plane. Thus, if an image forming apparatus is designed so that the inclination angle detecting means detects the inclination angle of the toner supplying mechanism 52 itself, the same effects as those in the preceding embodiments can be obtained even if the toner supplying mechanism 52 becomes inclined relative to the horizontal plane when the apparatus main assembly 110 is on a horizontal surface.

Also in each of the preceding embodiments, the image forming apparatus employed the intermediary transfer system. However, these embodiments are not intended to limit the present invention in scope. That is, it will be evident to the people in this business of image formation that the present invention is equally applicable to an image forming apparatus which employs one of the well-known direct transfer systems. An image forming apparatus which employs a direct transfer system has a transfer medium bearing member, for example, a conveyer belt, which bears and conveys transfer medium. The multiple toner images formed, one for one, on multiple image bearing members aligned in parallel in the direction in which the surface of the conveyer belt moves, are sequentially transferred onto the transfer medium borne on the conveyer belt, to form an image made up of multiple toners different in color.

Also as is well-known to the people in this business of image formation, there are image forming apparatuses which have a single image bearing member and multiple developing devices, and which form an image made up of multiple toners different in color, by sequentially forming multiple toner images different in color, and directly transferring the toner images onto transfer medium, or transferring the toner images onto recording medium after temporarily transferring the toner images onto the intermediary transferring member. The present invention is equally applicable to this type of image forming apparatus. Obviously, the present invention is also applicable to a monochromatic image forming apparatus which has only a single image forming portion.

Also in each of the preceding embodiments, the supplying means was a means for supplying the developing device with only toner. However, there have been known supplying systems which supply a developing device with both toner and carrier. The present invention is equally applicable to an image forming apparatus equipped with a supplying system which supplies a developing device with both toner and carrier.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 026338/2006 filed Feb. 2, 2006 which is hereby incorporated by reference.

What is claimed is:

1. An image forming apparatus comprising:

an image bearing member on which an electrostatic image is formed on the basis of an image signal;

a developing device for developing the electrostatic image formed on said image bearing member with a developer including toner and a carrier;

a supplying apparatus for supplying into said developing device a developer including toner on the basis of the image signal by rotating a feeding screw;

an inclination detecting device for detecting an inclination of said feeding screw; and a controller for controlling a rotating duration of said feeding screw or a rotational speed of said feeding screw for a predetermined image signal so that rotating duration or the rotating speed increases with an increase of an angle of the inclination of said feeding screw on the basis of a result of a detection result of said inclination detecting device and where the angle is positive in such a direction that a downstream side of said feeding screw with respect to a developer feeding direction moves upward beyond an upstream side of said feeding screw.

2. An apparatus according to claim 1, further comprising an ambient condition detecting device for detecting an ambient condition under which a main assembly of said image forming apparatus is placed, wherein said controller controls the rotation of said feeding screw on the basis of a result of detection of said ambient condition detecting device and the result of detection of said inclination detecting device.

3. An apparatus according to claim 1, further comprising a storing device for storing information for interrelating the result of detection of said inclination device and the rotation time or the rotational speed.

4. An apparatus according to claim 1, wherein a reference toner image is formed, said apparatus further comprising an image density detecting device for detecting a density of the reference toner image, and wherein said controller controls rotation of said feeding screw on the basis of a result of detection of said image density detecting device, and said image density detecting device controls a frequency of reference toner image forming operation on the basis of the result of detection of said inclination detecting device.

5. An apparatus according to claim 4, further comprising a storing device for storing information for interrelating the result of detection of said inclination detecting device and the frequency of the reference toner image forming operation.

6. An image forming apparatus comprising:

an image bearing member on which an electrostatic image is formed;

a developing device for developing the electrostatic image formed on said image bearing member with a developer including toner and a carrier, wherein a reference toner image is formed;

an image density detecting device for detecting a density of the reference toner image;

a supplying apparatus for supplying into said developing device a developer including toner by rotating a feeding screw;

a controller for controlling rotation of said feeding screw on the basis of a result of detection of said image density detecting device, an inclination detecting device for detecting an inclination of said feeding screw, wherein said image density detecting device increases a frequency of reference toner image forming operation with an increase of the inclination of said feeding screw.

* * * * *